US007581587B2

(12) United States Patent
Pfefferle

(10) Patent No.: US 7,581,587 B2
(45) Date of Patent: Sep. 1, 2009

(54) METHOD FOR IN-SITU COMBUSTION OF IN-PLACE OILS

(75) Inventor: William C. Pfefferle, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 251 days.

(21) Appl. No.: 11/646,002

(22) Filed: Dec. 27, 2006

(65) Prior Publication Data

US 2007/0256833 A1 Nov. 8, 2007

Related U.S. Application Data

(60) Provisional application No. 60/756,020, filed on Jan. 3, 2006.

(51) Int. Cl.
*E21B 43/243* (2006.01)
*E21B 43/30* (2006.01)

(52) U.S. Cl. ..... 166/245; 166/256; 166/257; 166/272.1; 166/272.7; 166/306

(58) Field of Classification Search ..... 166/272.7, 166/306
See application file for complete search history.

(56) References Cited

U.S. PATENT DOCUMENTS

| | | | | | |
|---|---|---|---|---|---|
| 1,269,747 | A | * | 6/1918 | Rogers | 299/2 |
| 3,548,938 | A | * | 12/1970 | Parker | 166/256 |
| 3,565,174 | A | * | 2/1971 | Parker et al. | 166/261 |
| 4,043,393 | A | * | 8/1977 | Fisher et al. | 166/248 |
| 4,169,506 | A | * | 10/1979 | Berry | 166/256 |
| 4,384,613 | A | * | 5/1983 | Owen et al. | 166/256 |
| 4,662,443 | A | * | 5/1987 | Puri et al. | 166/261 |
| 5,217,076 | A | * | 6/1993 | Masek | 166/303 |
| 5,339,897 | A | * | 8/1994 | Leaute | 166/245 |
| 5,456,315 | A | * | 10/1995 | Kisman et al. | 166/245 |
| 5,626,191 | A | * | 5/1997 | Greaves et al. | 166/245 |
| 6,016,868 | A | * | 1/2000 | Gregoli et al. | 166/261 |

* cited by examiner

*Primary Examiner*—George Suchfield
(74) *Attorney, Agent, or Firm*—Robert L. Rispoli

(57) ABSTRACT

A novel method is provided for in situ combustion and recovery of oil from underground reservoirs including injecting air into the reservoir at a region near the reservoir floor, withdrawing combustion products from a region near the reservoir ceiling, and collecting oil from a horizontal production well near the reservoir floor.

9 Claims, 2 Drawing Sheets

FIGURE 1 – PRIOR ART

METHOD FOR IN-SITU COMBUSTION OF IN-PLACE OILS

CROSS-REFERENCE

This application claims the benefit of U.S. Provisional Application No. 60/756,020 filed Jan. 3, 2006.

FIELD OF THE INVENTION

This invention relates to a method for contacting carbonaceous deposits in a sub-surface formation with a reactive fluid whereby such deposits may be mobilized thus allowing for recovery. More specifically, the invention relates to a method for efficient recovery and upgrading of heavy oils.

BACKGROUND OF THE INVENTION

In-situ combustion is an established method for enhanced oil recovery. In a typical application, air is injected into a vertical well resulting in combustion and increased oil mobility. Product oil is then recovered via either the injection well by a process known as huff-and-puff or via a second vertical well. The process is not widely used because it has been difficult to control. Thus attempts have been made to improve the process.

To reduce the problem of gravity segregation, for example, air is injected at a high point of the reservoir. U.S. Pat. No. 5,211,230 teaches injecting air at a high point of the reservoir via a vertical well along with a lower horizontal production well. U.S. Pat. No. 5,626,191 teaches placing the low horizontal well perpendicular to the vertical well to draw the combustion front along the horizontal well and away from the injection well. Although this is an improvement, combustion products are intended to be removed with the heated oil and thus injected fresh air also has ready access to the horizontal well between the toe and the combustion front. A further disadvantage is that the injection well and the horizontal well vertical leg must be located far apart. Accordingly, there is still a need for a process which is controllable and provides efficient use of injected air.

SUMMARY OF THE INVENTION

It is an object of the present invention to provide an improved method of contacting an injected fluid with a reaction front whereby oil may be recovered economically. More specifically, it is a further object of the present invention to enable more efficient in-situ combustion of in-place heavy oil whereby combustion products are more efficiently removed from the combustion zone and thermal cracking is promoted.

In the present invention, air is injected near the reservoir floor allowing the hot combustion products to over-ride the cooler fresh air. The cooler air is thus drawn to the combustion front aided by withdrawal of combustion products via a bleed well located at a point well above the reservoir floor. Use of a horizontal bleed well permits steering of combustion front travel. Advantageously, oil is recovered via a horizontal production well having its heel (the transition from horizontal to vertical rise to the surface) near the injection well. This means that the production well can be maintained liquid full throughout the air rich burned out zone blocking loss of injected air.

Combustion product gases may be withdrawn from a region near the top of the reservoir, preferably at an elevated pressure near the reservoir pressure. Passage of the withdrawn gases through a power turbine allows recovery of a portion of the energy required for compression of the injection air. Combustion of fuel to utilize oxidant in the withdrawn gases increases power output of the power turbine. Fresh air may be added as necessary to combust fuel values present in the combustion products.

An advantage of the present invention is that the oil recovery well(s) may be drilled from the same platform as the injection and bleed wells thereby reducing the environmental impact. Multiple production wells may be utilized depending upon the reservoir geometry. Typically, it will be advantageous to place the injection well at a low point in the reservoir. In addition, the required wells need not terminate directly under the production platform. If desired, injection and production wells may be drilled from separate platforms located some distance apart with the production well toe (i.e., horizontal terminus) located near the injection well.

DESCRIPTION OF THE INVENTION

Figure 1:
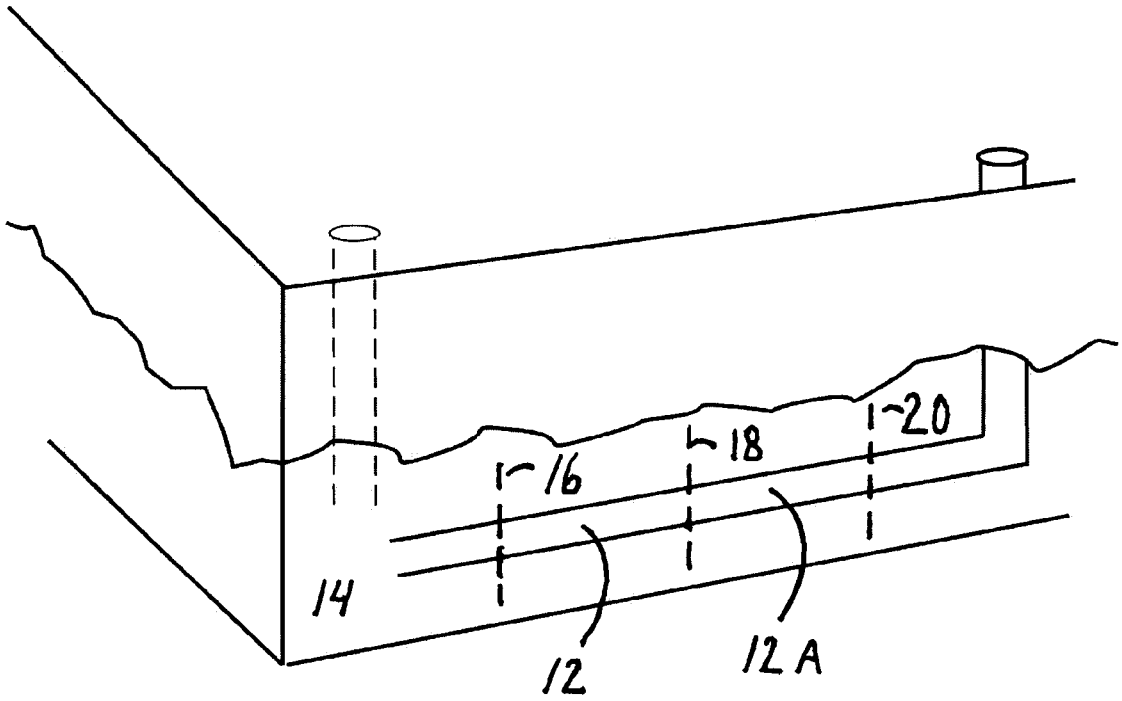
FIG. 1 is a schematic representation of the state of the art system of U.S. Pat. No. 5,626,191.

FIG. 1 depicts an advanced design in-situ combustion system of the prior art. Unlike the system of the present invention, excess combustion gases are withdrawn via the horizontal production well 12. Thus the horizontal section 12A of well 12 that lies within burned out zone 14 cannot withdraw combustion gases without preferentially bleeding off fresh air. As the combustion front progresses from location 16 through representative locations 18, 20, etc., loss of fresh combustion air worsens. To minimize fresh air loss, the toe section may be at a lower elevation than the heel so that the leg between the toe and the combustion front remains liquid full. This also allows oil to drain out of the toe into the reservoir. Even so, this is only a partial solution since hot gases will still tend to over-ride the cooler fresh air at the withdrawal point. The result is energy loss.

Figure 2:
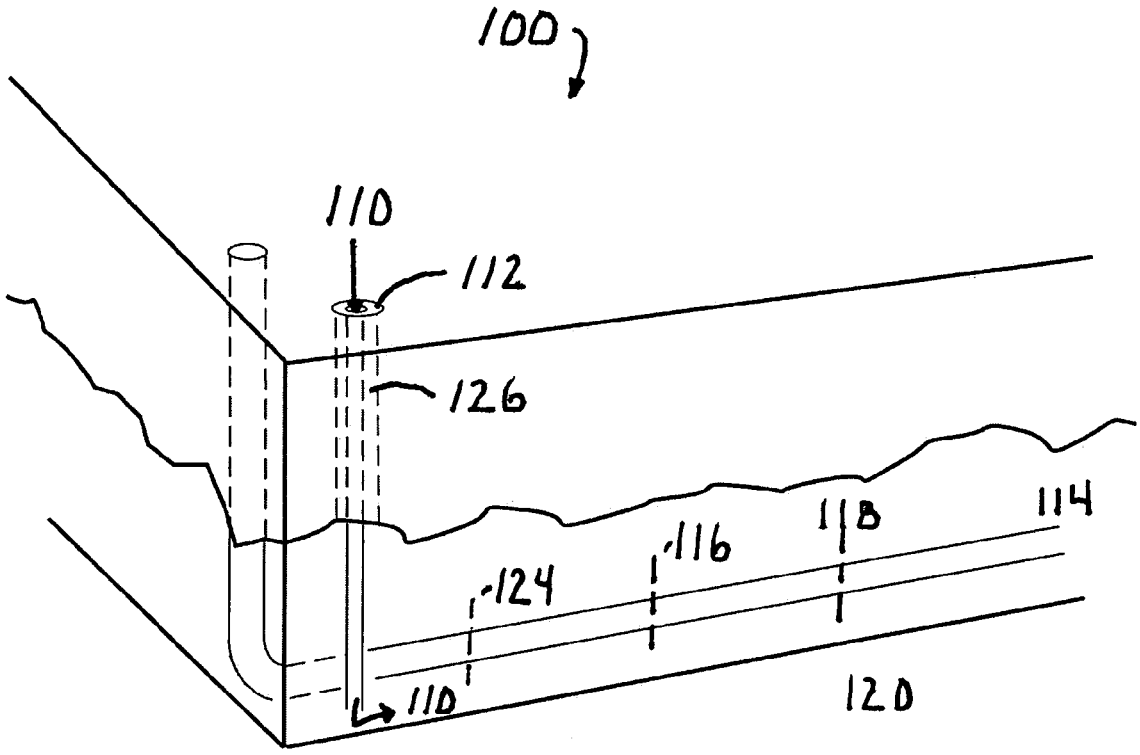
FIG. 2 is a schematic representation of the present invention.

Referring to the drawings, FIG. 2 depicts a well pattern 100 for in-situ combustion according to the present invention. Air 110 is injected via well 112 at the bottom of reservoir 114 flowing to combustion front 116. Heated oil 118 drains to the reservoir floor on rock bed 120 and is withdrawn at a controlled rate such that horizontal well 122 is liquid full throughout burned out zone 124. Hot combustion gases rise at combustion front 116 and are withdrawn via concentric well 126 for energy recovery in a turbine (not shown). Well 126 need not be concentric with injection well 112 and may be located as the reservoir structure dictates or may be a horizontal well. Regardless, it is typically advantageous to drill all wells from a common platform.

While the present invention has been described in considerable detail, other configurations exhibiting the characteristics taught herein for a method for in-situ combustion of in-place oils are contemplated. Therefore, the spirit and scope of the invention should not be limited to the description of the preferred embodiments described herein.

The invention claimed is:

1. A method of in-situ combustion for recovery of oil from an underground oil reservoir comprising:

a) injecting air into the reservoir via an injection well in a region near the reservoir floor;

b) establishing a combustion front wherein hot combustion gases rise at the combustion front with combustion progressing from heel to toe;

c) withdrawing combustion products from a region near the reservoir ceiling whereby heated oil drains to the reservoir floor; and d) collecting oil from a horizontal production well near the reservoir floor whereby the horizontal production well defines a heel proximate to the injection well.

2. The method of claim 1 wherein combustion products are withdrawn through a bleed well located above an air injection well flow exit.

3. The method of claim 2 wherein the bleed well includes a horizontal section perpendicular to a vertical injection well.

4. The method of claim 1 wherein withdrawn combustion products are passed to an expansion turbine for energy recovery.

5. The method of claim 4 wherein fuel is combusted to heat the combustion products before expansion.

6. The method of claim 1 wherein the production well is drilled from the same platform as an air injection well.

7. The method of claim 1 wherein the toe of the production well is at a higher elevation than the heel.

8. The method of claim 1 wherein the production well is a horizontal well perpendicular to an injection well.

9. The method of claim 1 wherein combustion products are withdrawn through multiple bleed wells.

* * * * *